US009498011B2

(12) United States Patent
Chan et al.

(10) Patent No.: US 9,498,011 B2
(45) Date of Patent: Nov. 22, 2016

(54) INTELLIGENT ADJUSTABLE MANNEQUIN

(71) Applicant: The Hong Kong Polytechnic University, Hong Kong (CN)

(72) Inventors: Cheekooi Chan, Hong Kong (CN); Sixiang Peng, Hong Kong (CN); Ameersing Luximon, Hong Kong (CN)

(73) Assignee: The Hong Kong Polytechnic University, Hong Kong (CN)

( * ) Notice: Subject to any disclaimer, the term of this patent is extended or adjusted under 35 U.S.C. 154(b) by 26 days.

(21) Appl. No.: 14/420,117

(22) PCT Filed: Jul. 29, 2013

(86) PCT No.: PCT/CN2013/080277
§ 371 (c)(1),
(2) Date: Feb. 6, 2015

(87) PCT Pub. No.: WO2014/023168
PCT Pub. Date: Feb. 13, 2014

(65) Prior Publication Data

US 2015/0189937 A1 Jul. 9, 2015

(30) Foreign Application Priority Data

Aug. 7, 2012 (CN) ..... 2012 1 0279971

(51) Int. Cl.
*A41H 5/01* (2006.01)
*A47F 8/00* (2006.01)

(52) U.S. Cl.
CPC .. *A41H 5/01* (2013.01); *A47F 8/00* (2013.01)

(58) Field of Classification Search
CPC ..... A47F 8/00; A41H 5/01; G06T 17/00; G09B 23/32
See application file for complete search history.

(56) References Cited

U.S. PATENT DOCUMENTS

| | | | |
|---|---|---|---|
| 269,851 | A | 1/1883 | Hall |
| 393,799 | A | 12/1888 | Tuck et al. |
| 397,986 | A | 2/1889 | Johnson |
| 427,510 | A | 5/1890 | Hebert |
| 468,308 | A | 2/1892 | Brown |
| 479,232 | A | 7/1892 | Vogler |
| 913,329 | A | 2/1909 | Ufford |

(Continued)

FOREIGN PATENT DOCUMENTS

| | | | |
|---|---|---|---|
| AU | WO2012024745 | A1 * | 3/2012 |
| CN | 1759779 | | 4/2006 |

(Continued)

*Primary Examiner* — Ismael Izaguirre

(74) *Attorney, Agent, or Firm* — McDonnell Boehnen Hulbert & Berghoff LLP

(57) ABSTRACT

An intelligent adjustable mannequin having a body shape parameter input module and a mannequin backbone structure, the mannequin including an adjustment plate on the backbone structure according to body shape parameters, a curse adjustment mechanism positioned between the adjustment plate and the backbone structure, the backbone structure is also provided with a detector which detects the body shape parameters, and a relative movement between the adjustment plate and the backbone structure is controlled by the girth adjustment mechanism to achieve precise adjustment of body shape curse parameters. The backbone structure is further provided with a length adjustment mechanism to control upward and downward movements of respective parts of the backbone structure to achieve precise adjustment of length parameters.

9 Claims, 4 Drawing Sheets

(56) References Cited

U.S. PATENT DOCUMENTS

| | | | | | |
|---|---|---|---|---|---|
| 963,724 | A | | 7/1910 | Rubin | |
| 974,936 | A | | 11/1910 | Van Dusen | |
| 986,041 | A | | 3/1911 | Boyd | |
| 1,153,218 | A | | 9/1915 | Granger | |
| 1,165,045 | A | | 12/1915 | Ufford | |
| 1,168,653 | A | | 1/1916 | Kubal | |
| 1,221,522 | A | | 4/1917 | Farquharson | |
| 1,259,808 | A | | 3/1918 | Ufford | |
| 1,267,937 | A | | 5/1918 | Ufford | |
| 2,056,740 | A | | 10/1936 | Rosenfeld | |
| 2,284,967 | A | | 6/1942 | Ray et al. | |
| 2,332,689 | A | * | 10/1943 | Bell | A41H 5/01 223/70 |
| 2,367,171 | A | | 1/1945 | Kroll | |
| 2,620,099 | A | | 12/1952 | Laikauf | |
| 2,666,559 | A | | 1/1954 | Weeler et al. | |
| 2,817,469 | A | | 12/1957 | Crohn | |
| 2,879,928 | A | | 3/1959 | Stoddard | |
| 3,096,916 | A | | 7/1963 | Ronell | |
| 3,191,821 | A | | 6/1965 | Levin et al. | |
| 4,592,496 | A | | 6/1986 | Nishi | |
| 5,265,779 | A | | 11/1993 | Jiang | |
| 5,615,318 | A | * | 3/1997 | Matsuura | A41H 3/007 345/419 |
| 8,186,546 | B2 | * | 5/2012 | Wang | A41H 5/01 223/68 |
| 2004/0222249 | A1 | | 11/2004 | Bentham et al. | |
| 2007/0275632 | A1 | | 11/2007 | Barra | |
| 2010/0070384 | A1 | | 3/2010 | Kruusmaa et al. | |
| 2011/0121040 | A1 | | 5/2011 | Wang | |
| 2012/0316827 | A1 | * | 12/2012 | Wilkinson | A41H 1/00 702/150 |
| 2013/0292428 | A1 | * | 11/2013 | Catanese | A47F 8/00 223/84 |
| 2015/0004584 | A1 | * | 1/2015 | Galibois | G09B 23/30 434/270 |

FOREIGN PATENT DOCUMENTS

| | | |
|---|---|---|
| CN | 101567074 | 10/2009 |
| CN | 101776494 | 7/2010 |
| CN | 101862044 | 10/2010 |
| CN | 101961186 | 2/2011 |
| CN | 102044038 | 5/2011 |
| DE | 145985 | 6/1902 |
| FR | 324566 | 1/1930 |
| JP | 03-014604 | 1/1991 |
| WO | WO 2010/096878 | 9/2010 |

* cited by examiner

INTELLIGENT ADJUSTABLE MANNEQUIN

TECHNICAL FIELD

The present invention relates to a clothing-manufacturing tool in the garment industry, and more particularly, to an intelligent adjustable mannequin designed in three-dimensional clothing cutting.

BACKGROUND

With the development of society and economy, more and more people pursue individualized design to express their dress sense. People hope that clothing manufactured by clothing manufactures may perfectly satisfy their physical features and aesthetics needs. A mannequin is an important tool in the field of fashion clothing. In the garment industry, tasks such as clothing design, fitting, clothing alterations and size classification need to use the mannequin, such that the clothing may better fit the shape of the mannequin. The process for producing the mannequin is very complex, which includes steps of 3D mannequin scanning, data analysis, sculpting, model making, processing, filling and alterations and the like. The process causes not only large amount of time but also many human resources. In the field of fashion clothing, a conventional method is manufacturing fitting mannequins of a plurality of sizes to fully cover consumers of all figures. Considering differentiation of market needs and body sizes of consumers, the method costs a considerable amount of money and space, and is inconvenient for implementation.

An adjustable mannequin may change a model shape by a mechanical manner, and in view of different model configurations, different designs may be used. Thus, the adjustable mannequin becomes a research focus in the field. A conventional belt adjustable mannequin may adjust length and girth sizes, but the belt adjustable mannequin has complicated operations and is difficult to be controlled into an accurate shape. A conventional plate-type adjustable mannequin can provide excellent support, but the plate-type adjustable mannequin has a heavy weight, complicated operations and high manufacturing expenses. Although other simple mannequins have low manufacturing expenses and simple operations, they have very few adjustable manners, and the formed shapes are stable. Chinese Patent Application CN200510017613.7 discloses a dress form that is capable of adjusting body shape parameters. Although the dress form may adjust girths of the shoulder, the chest, the waist and the hip, but it has complicated operations, and accuracy of controlling using software and interface manipulation is not available.

SUMMARY

Technical problems sought to be solved by the present invention are, aiming at problems in conventional technologies that the adjustable mannequin has complicated operations, high manufacturing expenses, low size adjustment precision and poor forming shape, to provide an intelligent adjustable mannequin which may precisely controls girths and length sizes of respective parts by a user-friendly interactive body shape parameter input module and has advantages of low manufacturing expenses and simple operations.

Technical solution used by the present invention to solve the technical problems is to provide an adjustable mannequin which includes a body shape parameter input module and backbone structure. The adjustable mannequin is characterized in that, an adjustment plate is provided on the backbone structure according to body shape parameters, a girth adjustment mechanism is provided between the adjustment plate and the backbone structure, the backbone structure is also provided with a detector, the detector detects body shape parameters input by the body shape parameter input module, a relative movement between the adjustment plate and the backbone structure is controlled by the girth adjustment mechanism to achieve precise adjustment of body shape girth parameters, the backbone structure is further provided with a length adjustment mechanism, the detector detects the body shape parameters input by the body shape parameter input module, and upward and downward movements of respective parts of the backbone structure are controlled by the length adjustment mechanism to achieve precise adjustment of length parameters.

Preferably, the girth adjustment mechanism and the adjustment plate include a neck girth adjustment mechanism and a neck girth adjustment plate, a chest girth adjustment mechanism and a chest girth adjustment plate, a waist girth adjustment mechanism and a waist girth adjustment plate, and a hip girth adjustment mechanism and a hip girth adjustment plate.

Preferably, the body shape parameter input module includes a piece of interactive software for driving the mannequin so as to guarantee precision.

Preferably, in the neck girth adjustment mechanism and the neck girth adjustment plate, four neck girth adjustment plates are provided at a neck position of the mannequin; in the chest girth adjustment mechanism and the chest girth adjustment plate, two chest girth adjustment plates are provided at a chest position of the mannequin; in the waist girth adjustment mechanism and the waist girth adjustment plate, two waist girth adjustment plates are provided at an abdomen position of the mannequin; and in the hip girth adjustment mechanism and the hip girth adjustment plate, two hip girth adjustment plates are provided at the hip of the mannequin.

Preferably, the neck girth adjustment plate is adjusted by the neck girth adjustment mechanism, a motor is provided in the neck girth adjustment mechanism, the motor drives a gear to rotate to move a rack up and down, and a threaded rod connected to the rack and the neck girth adjustment plate moves in a direction away from or approaching the backbone structure according to movements of the rack to achieve adjustment of neck girth parameters.

Preferably, the chest girth adjustment plate is adjusted by the chest girth adjustment mechanism, a motor is provided in the chest girth adjustment mechanism, the motor drives a gear to rotate to move a rack outwardly or inwardly, and a threaded rod connected to the rack and the chest girth adjustment plate moves in a direction away from or approaching the backbone structure according to movements of the rack to achieve adjustment of chest girth parameters.

Preferably, the waist girth adjustment plate is adjusted by the waist girth adjustment mechanism, a motor is provided in the waist girth adjustment mechanism, the motor drives a gear to rotate to move a rack outwardly or inwardly, and a threaded rod connected to the rack and the waist girth adjustment plate moves in a direction away from or approaching the backbone structure according to movements of the rack to achieve adjustment of waist girth parameters.

Preferably, the hip girth adjustment plate is adjusted by the hip girth adjustment mechanism, a motor is provided in the hip girth adjustment mechanism, the motor drives a gear to rotate to move a rack outwardly or inwardly, and a threaded rod connected to the rack and the hip girth adjustment plate moves in a direction away from or approaching the backbone structure according to movements of the rack to achieve adjustment of hip girth parameters.

Preferably, the length adjustment mechanism includes a neck flange installed on the backbone structure and a neck support plate fixed on the neck flange, the neck adjustment mechanism and the neck girth adjustment plate are provided on the neck support plate, and the neck flange is moved upward or downward to make the neck support plate move upward or downward so as to adjust a length of the neck.

Preferably, the length adjustment mechanism includes a chest flange installed on the backbone structure and a chest support plate fixed on the chest flange, the chest adjustment mechanism and the chest girth adjustment plate are provided on the chest support plate, and the chest flange is moved upward or downward to make the chest support plate move upward or downward so as to adjust a length between the chest and the waist.

Preferably, the length adjustment mechanism includes a waist flange installed on the backbone structure and a waist support plate fixed on the waist flange, the waist adjustment mechanism and the waist girth adjustment plate are provided on the waist support plate, and the waist flange is moved upward or downward to make the waist support plate move upward or downward so as to adjust a length between the waist and the hip.

The implementation of the present invention may arrive at the following advantageous effects: the intelligent adjustable mannequin has simple operations and low manufacturing expenses, and inputting the body shape parameters by software and operation interface of the body shape parameter input module may precisely control adjustment of sizes of body shape.

BRIEF DESCRIPTION OF THE DRAWINGS

Hereinafter, the present invention will be further explained in conjunction with the accompanying drawings and embodiments, in the drawings.

DETAILED DESCRIPTION

Figure 1:
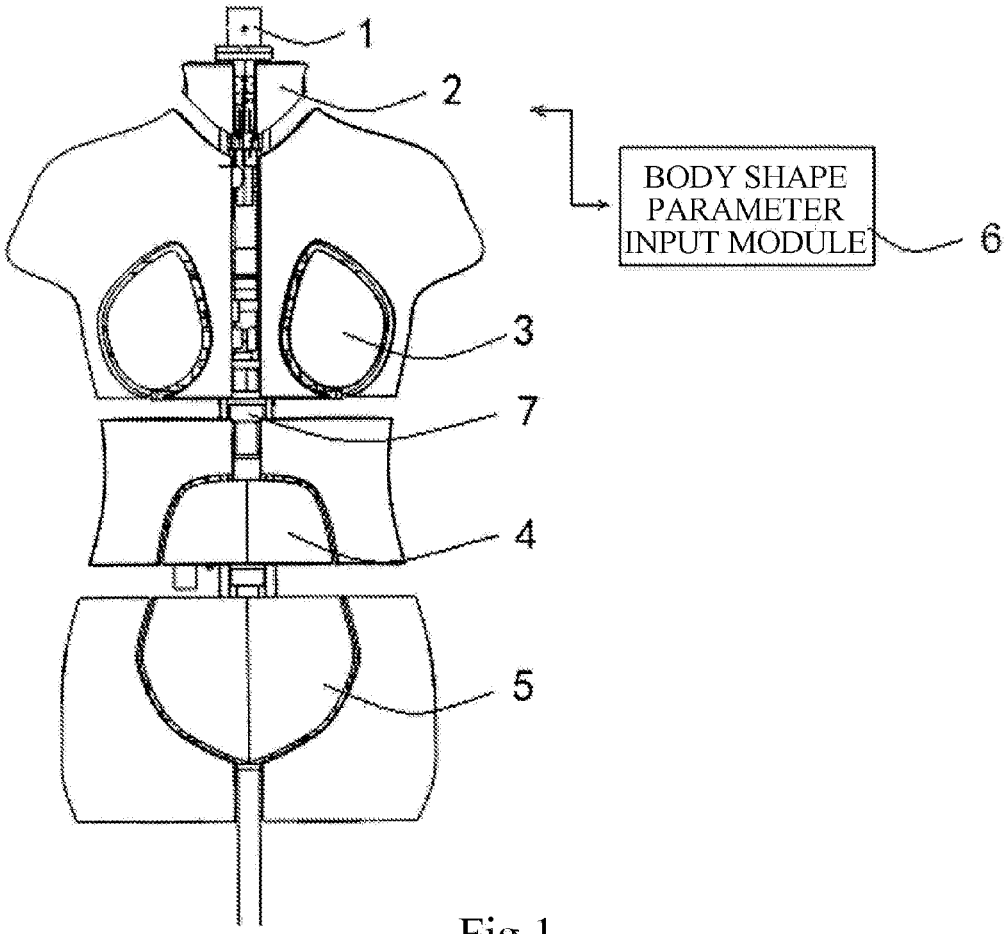
FIG. 1 is a structure schematic diagram of an intelligent adjustable mannequin of the present invention.

According to an exemplary embodiment of the present invention, referring to FIG. 1, an intelligent adjustable mannequin includes a body shape parameter input module 6 and a mannequin backbone structure 1. The intelligent adjustable mannequin is characterized in that, an adjustment plate is provided on the mannequin backbone structure 1 according to body shape parameters, a girth adjustment mechanism is provided between the adjustment plate and the backbone structure 1, the backbone structure 1 is also provided with a detector 7, the detector 7 detects the body shape parameters input by the body shape parameter input module 6, and a relative movement between the adjustment plate and the backbone structure is controlled by the girth adjustment mechanism to achieve precise adjustment of body shape girth parameters. The backbone structure 1 is further provided with a length adjustment mechanism, the detector 7 detects the body shape parameters input by the body shape parameter input module 6, and upward and downward movements of respective parts of the backbone structure are controlled by the length adjustment mechanism to achieve precise adjustment of length parameters.

Figure 2:
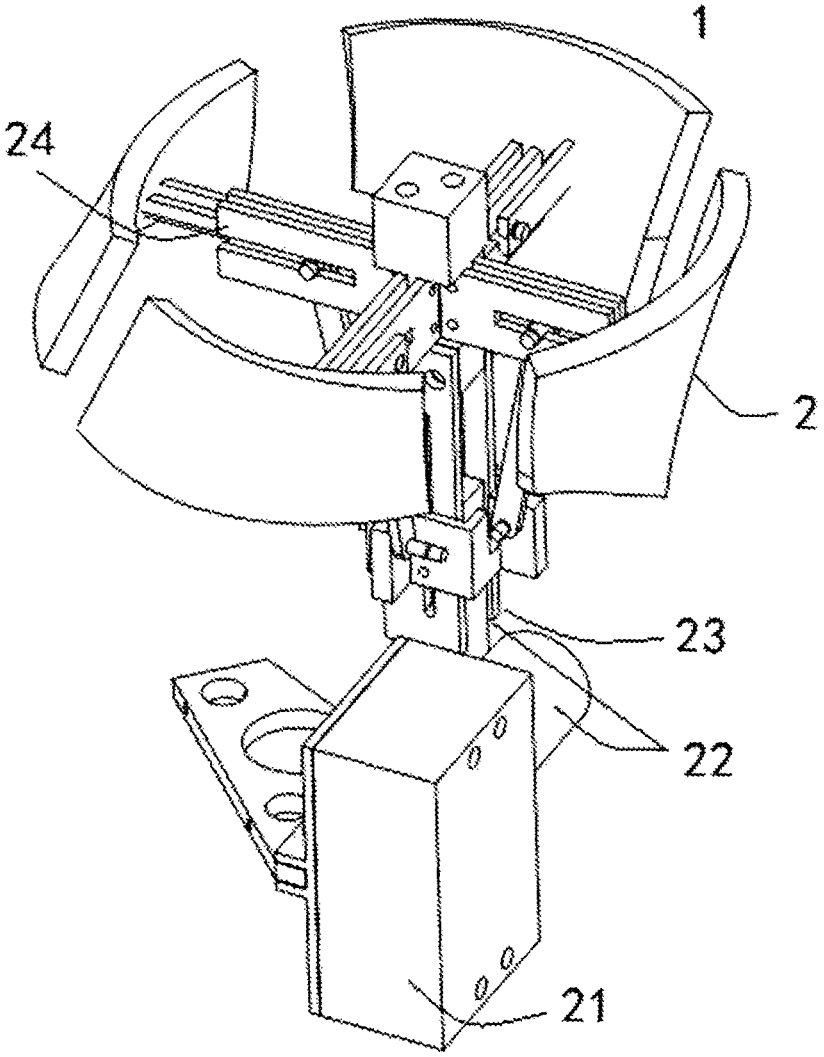
FIG. 2 is a structure schematic diagram of neck related parts of an intelligent adjustable mannequin of the present invention.
Figure 3:
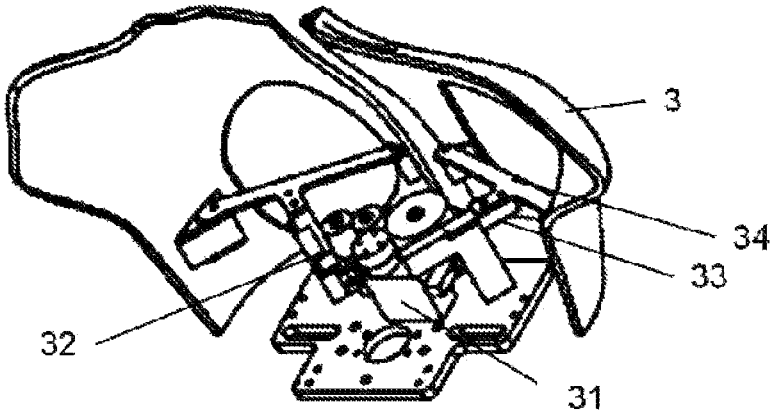
FIG. 3 is a structure schematic diagram of chest related parts of an intelligent adjustable mannequin of the present invention.

According to an exemplary embodiment of the present invention, referring to FIGS. 1, 2 and 3, the girth adjustment mechanism and the adjustment plate include a neck girth adjustment mechanism and a neck girth adjustment plate 2, a chest girth adjustment mechanism and a chest girth adjustment plate 3, a waist girth adjustment mechanism and a waist girth adjustment plate 4, and a hip girth adjustment mechanism and a hip girth adjustment plate 5. As shown in FIG. 1, the intelligent adjustable mannequin of the present invention includes the backbone structure 1. On the backbone structure 1, the neck girth adjustment plate 2 capable of adjusting a neck girth size is provided at a neck position, the chest girth adjustment plate 3 capable of adjusting a chest girth size is provided at a chest position, the waist girth adjustment plate 4 capable of adjusting a waist girth size is provided at an abdomen position, and the hip girth adjustment plate 5 capable of adjusting a hip size is provided at a hip position.

According to an exemplary embodiment of the present invention, the body shape parameter input module 6 includes a piece of interactive software for driving the mannequin so as to guarantee precision. During specific implementation, the body shape parameter input module 6 is connected to the mannequin in a wired or wireless manner, and inputs body shape parameter and size of a consumer into the interactive software, and the detector 7 detects the input parameters and sizes and adjusts girths and lengths of the respective parts.

According to an exemplary embodiment of the present invention, in the neck girth adjustment mechanism and the neck girth adjustment plate 2, four neck girth adjustment plates 2 are provided at the neck position of the mannequin; in the chest girth adjustment mechanism and the chest girth adjustment plate 3, two chest girth adjustment plates 3 are provided at the chest portion of the mannequin; in the waist girth adjustment mechanism and the waist girth adjustment plate 4, two waist girth adjustment plates 4 are provided at the abdomen position of the mannequin; and in the hip girth adjustment mechanism and the hip girth adjustment plate 5, two hip girth adjustment plates 5 are provided at the hip position of the mannequin.

According to an exemplary embodiment of the present invention, referring to FIG. 2, the neck girth adjustment plate 2 is adjusted by the neck girth adjustment mechanism. A motor 21 is provided in the neck girth adjustment mechanism, the motor 21 drives a gear 22 to rotate to move a rack 23 up and down, and a threaded rod 24 connected to the rack 23 and the neck girth adjustment plate 2 moves in a direction away from or approaching the backbone structure 1 according to movements of the rack 23 to achieve adjustment of neck girth parameters.

According to an exemplary embodiment of the present invention, referring to FIG. 3, the chest girth adjustment plate 3 is adjusted by the chest girth adjustment mechanism. A motor 31 is provided in the chest girth adjustment mechanism, the motor 31 drives a gear 32 to rotate to move a rack 33 outwardly or inwardly, and a threaded rod 34 connected to the rack 33 and the chest girth adjustment plate 3 moves in a direction away from or approaching the backbone structure 1 according to movements of the rack 33 to achieve adjustment of chest girth parameters.

According to an exemplary embodiment of the present invention, the waist girth adjustment plate is adjusted by the waist girth adjustment mechanism. A motor is provided in the waist girth adjustment mechanism, the motor drives a gear to rotate to move a rack outwardly or inwardly, and a threaded rod connected to the rack and the waist girth adjustment plate moves in a direction away from or approaching the backbone structure according to movements of the rack to achieve adjustment of waist girth parameters. Working principles of the waist girth adjustment mechanism are similar to those of the chest girth adjustment mechanism shown in FIG. 3 except for that the position, the shape and the size of the waist girth adjustment plate may be different as needed, and thus it will not be iteratively described herein.

According to an exemplary embodiment of the present invention, the hip girth adjustment plate is adjusted by the hip girth adjustment mechanism. A motor is provided in the hip girth adjustment mechanism, the motor drives a gear to rotate to move a rack outwardly or inwardly, and a threaded rod connected to the rack and the hip girth adjustment plate moves in a direction away from or approaching the backbone structure according to movements of the rack to achieve adjustment of hip girth parameters. Working principles of the hip girth adjustment mechanism are similar to those of the chest girth adjustment mechanism shown in FIG. 3 except for that the position, the shape and the size of the hip girth adjustment plate may be different as needed, and thus it will not be iteratively described herein.

Figure 4:
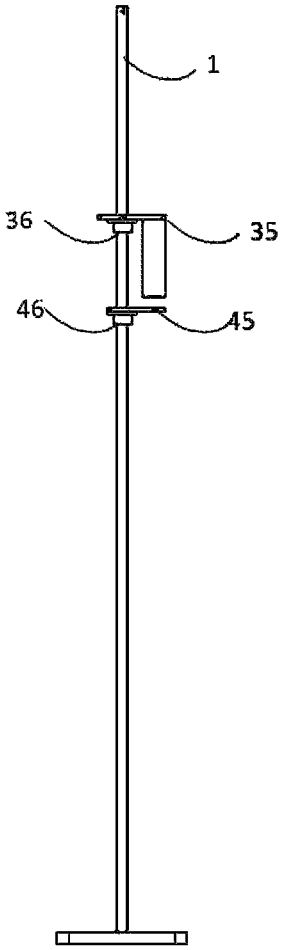
FIG. 4 is a structure schematic diagram of a length adjustment mechanism of an intelligent adjustable mannequin of the present invention.

According to an exemplary embodiment of the present invention, FIG. 4 is a schematic diagram of chest and waist parts of the present invention. Referring to FIG. 4, the length adjustment mechanism includes a chest flange 36 installed on the backbone structure 1 and a chest support plate 35 fixed on the chest flange, the chest adjustment mechanism and the chest girth adjustment plate 3 are provided on the chest support plate 35, and the chest flange 36 is moved upward or downward to make the chest support plate 35 move upward or downward so as to adjust a length between the chest and the waist.

According to an exemplary embodiment of the present invention, referring to FIG. 4, the length adjustment mechanism may include a waist flange 46 installed on the backbone structure 1 and a waist support plate 45 fixed on the waist flange 46, the waist adjustment mechanism and the waist girth adjustment plate 4 are provided on the waist support plate 45, and the waist flange 46 is moved upward or downward to make the waist support plate 45 move upward or downward so as to adjust a length between the waist and the hip.

According to an exemplary embodiment of the present invention, the length adjustment mechanism may include a neck flange installed on the backbone structure 1 and a neck support plate fixed on the neck flange, the neck adjustment mechanism and the neck girth adjustment plate are provided on the neck support plate, and the neck flange is moved upward or downward to make the neck support plate move upward or downward so as to adjust a length of the neck. The length adjustment mechanism of the neck is the same in principles as those of other length adjustment mechanisms, and thus it will not be iteratively described herein.

The present invention is described by some embodiments, and those skilled in the art know that various changes or equivalent substitutions may be made to these features and embodiments without departing from the spirit and scope of the present invention. In addition, under the teaching of the present invention, these features and embodiments may be modified to be adaptive to specific situations and materials without departing the spirit and scope of the present invention. Thus, the present invention is not limited by detailed embodiments disclosed herein, but all embodiments that fall into the scope of the claims of the present application belong to the protection scope of the present invention.

What is claimed is:

1. An intelligent adjustable mannequin comprising a body shape parameter input module and a backbone structure, wherein the intelligent adjustable further comprises:

an adjustment plate provided on the backbone structure according to body shape parameters;

a girth adjustment mechanism provided between the adjustment plate and the backbone structure;

a detector provided on the backbone structure, the detector detecting body shape parameters input by the body shape parameter input module;

wherein a relative movement between the adjustment plate and the backbone structure is controlled by the girth adjustment mechanism to achieve precise adjustment of body shape girth parameters;

wherein the backbone structure is further provided with a length adjustment mechanism, the detector detects the body shape parameters input by the body shape parameter input module, and upward and downward movements of respective parts of the backbone structure are controlled by the length adjustment mechanism to achieve precise adjustment of length parameters;

wherein the backbone structure is further provided with a length adjustment mechanism, the detector detects the body shape parameters input by the body shape parameter input module, and upward and downward movements of respective parts of the backbone structure are controlled by the length adjustment mechanism to achieve precise adjustment of length parameters;

wherein the girth adjustment mechanism comprises a neck girth adjustment mechanism, a chest girth adjustment mechanism, a waist girth adjustment mechanism and a hip girth adjustment mechanism, and the adjustment plate comprises a neck girth adjustment plate, a chest girth adjustment plate, a waist girth adjustment plate and a hip girth adjustment plate;

wherein the neck girth adjustment plate is adjusted by the neck girth adjustment mechanism, a motor is provided in the neck girth adjustment mechanism, the motor drives a gear to rotate to move a rack up and down, and a threaded rod connected to the rack and the neck girth adjustment plate moves in a direction away from or approaching the backbone structure according to movements of the rack to achieve adjustment of neck girth parameters.

2. The intelligent adjustable mannequin according to claim 1, wherein the body shape parameter input module comprises a piece of interactive software for driving the mannequin so as to guarantee precision.

3. The intelligent adjustable mannequin according to claim 1, wherein four neck girth adjustment plates are provided at a neck position of the mannequin, two chest girth adjustment plates are provided at a chest position of the mannequin, two waist girth adjustment plates are provided at an abdomen position of the mannequin, and two hip girth adjustment plates are provided at the hip of the mannequin.

4. The intelligent adjustable mannequin according to claim 1, wherein the chest girth adjustment plate is adjusted by the chest girth adjustment mechanism, a motor is provided in the chest girth adjustment mechanism, the motor drives a gear to rotate to move a rack outwardly or inwardly, and a threaded rod connected to the rack and the chest girth adjustment plate moves in a direction away from or approaching the backbone structure according to movements of the rack to achieve adjustment of chest girth parameters.

5. The intelligent adjustable mannequin according to claim 1, wherein the waist girth adjustment plate is adjusted by the waist girth adjustment mechanism, a motor is provided in the waist girth adjustment mechanism, the motor drives a gear to rotate to move a rack outwardly or inwardly, and a threaded rod connected to the rack and the waist girth adjustment plate moves in a direction away from or approaching the backbone structure according to movements of the rack to achieve adjustment of waist girth parameters.

6. The intelligent adjustable mannequin according to claim 1, wherein the hip girth adjustment plate is adjusted by the hip girth adjustment mechanism, a motor is provided in the hip girth adjustment mechanism, the motor drives a gear to rotate to move a rack outwardly or inwardly, and a threaded rod connected to the rack and the hip girth adjustment plate moves in a direction away from or approaching the backbone structure according to movements of the rack to achieve adjustment of hip girth parameters.

7. The intelligent adjustable mannequin according to claim 1, wherein the length adjustment mechanism comprises a neck flange installed on the backbone structure and a neck support plate fixed on the neck flange, the neck adjustment mechanism and the neck girth adjustment plate are provided on the neck support plate, and the neck flange is moved upward or downward to make the neck support plate move upward or downward so as to adjust a length of the neck.

8. The intelligent adjustable mannequin according to claim 1, wherein the length adjustment mechanism comprises a chest flange installed on the backbone structure and a chest support plate fixed on the chest flange, the chest adjustment mechanism and the chest girth adjustment plate are provided on the chest support plate, and the chest flange is moved upward or downward to make the chest support plate move upward or downward so as to adjust a length between the chest and the waist.

9. The intelligent adjustable mannequin according to claim 1, wherein the length adjustment mechanism comprises a waist flange installed on the backbone structure and a waist support plate fixed on the waist flange, the waist adjustment mechanism and the waist girth adjustment plate are provided on the waist support plate, and the waist flange is moved upward or downward to make the waist support plate move upward or downward so as to adjust a length between the waist and the hip.

* * * * *